US007770721B2

(12) United States Patent
Orner

(10) Patent No.: US 7,770,721 B2
(45) Date of Patent: Aug. 10, 2010

(54) EYEWEAR PROTECTION DEVICE

(76) Inventor: Caroline Orner, 515 Surrey Ave., Apt. 2E, Hagerstown, MD (US) 21740

( * ) Notice: Subject to any disclaimer, the term of this patent is extended or adjusted under 35 U.S.C. 154(b) by 7 days.

(21) Appl. No.: 12/134,610

(22) Filed: Jun. 6, 2008

(65) Prior Publication Data

US 2009/0000964 A1 Jan. 1, 2009

Related U.S. Application Data

(60) Provisional application No. 60/929,484, filed on Jun. 29, 2007.

(51) Int. Cl.
*A45C 11/04* (2006.01)

(52) U.S. Cl. ..... 206/5; 150/154

(58) Field of Classification Search ..... 206/5; 150/154; 2/426; D16/330
See application file for complete search history.

(56) References Cited

U.S. PATENT DOCUMENTS

| | | | | | |
|---|---|---|---|---|---|
| 1,638,727 | A * | 8/1927 | Dadourian | ..... | 206/5 |
| 1,740,134 | A * | 12/1929 | Winston | ..... | 206/5 |
| 3,921,797 | A * | 11/1975 | Platt | ..... | 206/5 |
| 4,863,013 | A * | 9/1989 | Eastman | ..... | 206/5 |
| 5,032,019 | A * | 7/1991 | Burchett | ..... | 206/5 |
| 5,915,545 | A * | 6/1999 | Shackel et al. | ..... | 206/5.1 |
| 2009/0026095 | A1 * | 1/2009 | Lofland et al. | ..... | 206/5 |

* cited by examiner

*Primary Examiner*—J. Gregory Pickett

(57) ABSTRACT

A removable and reusable protective device that surrounds the lens portion of eyewear such as goggles. The device provides a light weight, flexible protective device that is soft enough to prevent scratching on a lens caused by any buckle, any head strap, or any outside element, for example. The device may comprise a light weight, flexible material that can be stored in pockets of clothing and sports equipment during use of the eyewear.

14 Claims, 5 Drawing Sheets

EYEWEAR PROTECTION DEVICE

BACKGROUND OF THE INVENTION

The present application is based upon and claims the benefit of priority from the prior U.S. Provisional Application No. 60/929,484 filed on Jun. 29, 2007, titled EYEWEAR PROTECTION DEVICE, the entire contents of which are incorporated herein by reference.

FIELD OF THE INVENTION

The present invention relates to a protective device for goggles and other eyewear.

BACKGROUND OF THE TECHNOLOGY

Goggles are used as eye protection for various individuals including athletes, workers, outdoor recreation participants, military personnel, etc. Scratching of a lens in the goggles reduces the quality of vision provided by the goggles. Goggles may be scratched while being worn by a user, during storage, and while being carried in a non-use position. Often, the goggles are stored or carried by users in a non-use manner for an extended period of time. Therefore, it is important to prevent potential damage during this period. In the past, it has been possible to place a pair of goggles into a case or a pouch. However, a case or pouch only protects the goggles from outside sources of scratching and does not protect the goggle lenses from scratches caused by other elements of the goggles, such as a buckle. Furthermore, a case, especially a hard case, may not be conveniently available when a pair of goggles is being carried in a non-use manner, such as when an athlete is carrying goggles between uses.

Therefore, there is a need for a goggle protective device that protects goggle lenses from damage that may be caused by outside elements as well as other elements of the goggles, and for one that is more conveniently available in the environment in which the goggles are used.

SUMMARY OF THE INVENTION

Aspects of the present invention solve these problems by providing a removable and reusable protective device that surrounds the lens portion of goggles. The device provides a light weight, flexible protective device that is soft enough to prevent scratching on a lens caused by any buckle or head strap. The device may comprise a light weight, flexible material that is non-abrasive and can easily be stored in pockets of clothing and sports equipment.

Other objects, features, and advantages will be apparent to persons of ordinary skill in the art from the following detailed description of the invention and the accompanying drawings.

BRIEF DESCRIPTION OF THE FIGURES

For a more complete understanding of the present invention, the needs satisfied thereby, and the objects, features, and advantages thereof, reference is now made to the following description taken in connection with the accompanying drawings.

DETAILED DESCRIPTION

Figure 1:
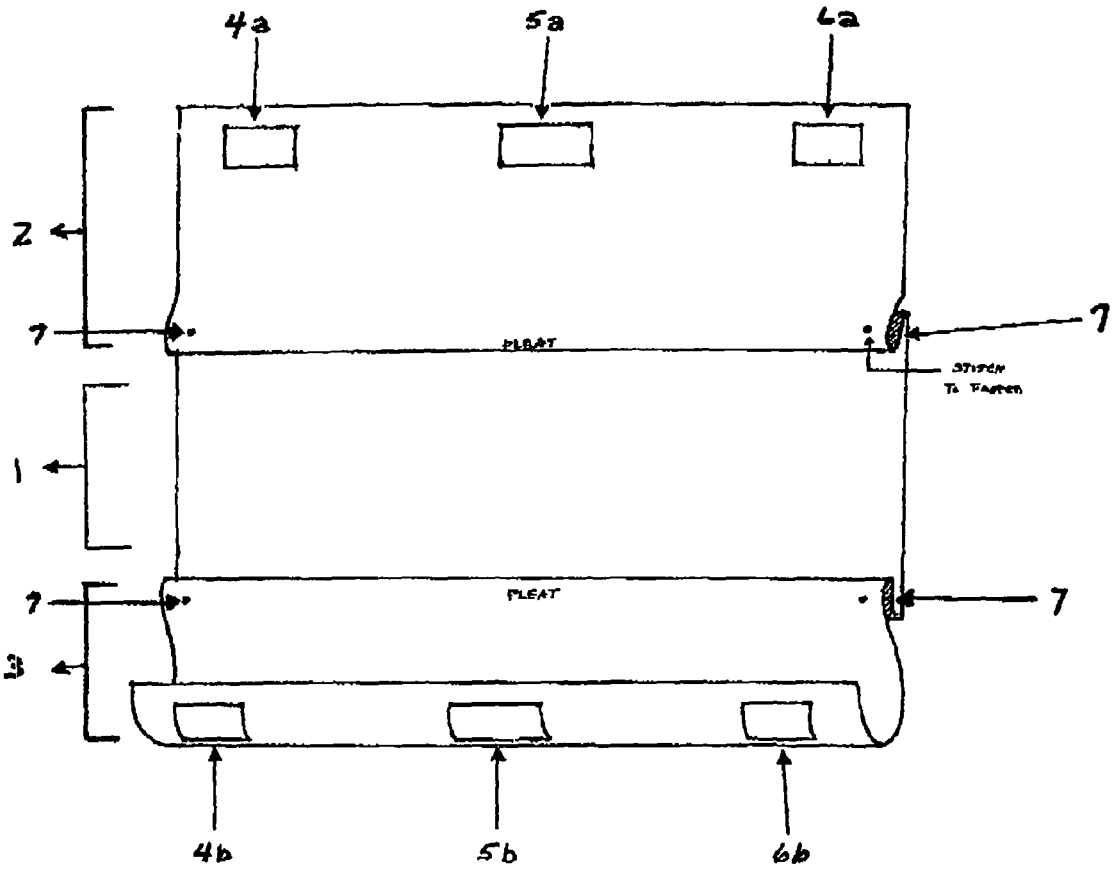
FIG. 1 shows an example of the eyewear protective device in accordance with aspects of the present invention.

With reference to FIG. 1, an exemplary variation in accordance with aspects of the present invention is shown. FIG. 1 shows an eyewear protective device comprising at least one protective layer of material shaped to surround a pair of goggles or other eyewear such that the lens portion is protected from both outside objects and the additional portions of the goggles, for example straps, buckles, earpieces, etc. Although only one layer of material is depicted in FIG. 1, the device may include a plurality of layers of material. For example, the device may include a liner layer.

FIG. 1 shows the eyewear protective device having a central portion 1 and two end portions 2, 3. The end portions 2, 3 are configured to attach to each other via at least one enclosure piece 4*a*-e*b*, 3*a*-3*b* and 4*a*-4*b* such that the device will surround the lens portion of the eyewear. The eyewear protection device surrounds the eyewear such that the central portion will be proximate to one side of the lens portion of the eyewear and the first and second ends will be attached to each other proximate to the opposite side of the lens portion and such that the device is located between any additional components of the eyewear, such as attachment pieces including earpieces, buckles, straps, etc.

The thickness of the at least one layer of material may be varied based on the goggles with which the device will be used. In addition, various thicknesses may be used for the same style of goggles so that a user may determine the level of protection necessary based on their personal applications.

In one exemplary variation, the device includes additional shaping so that the device will more fully surround the sides of the goggles. This additional shaping enables the device to more fully surround and protect the sides of the goggles. Furthermore, the additional shaping provides a more snug enclosure of the goggles, thereby preventing foreign objects from coming into contact with the lens of the goggle. As an exemplary implementation of such shaping, a pleat is shown in FIG. 1.

Figure 2:
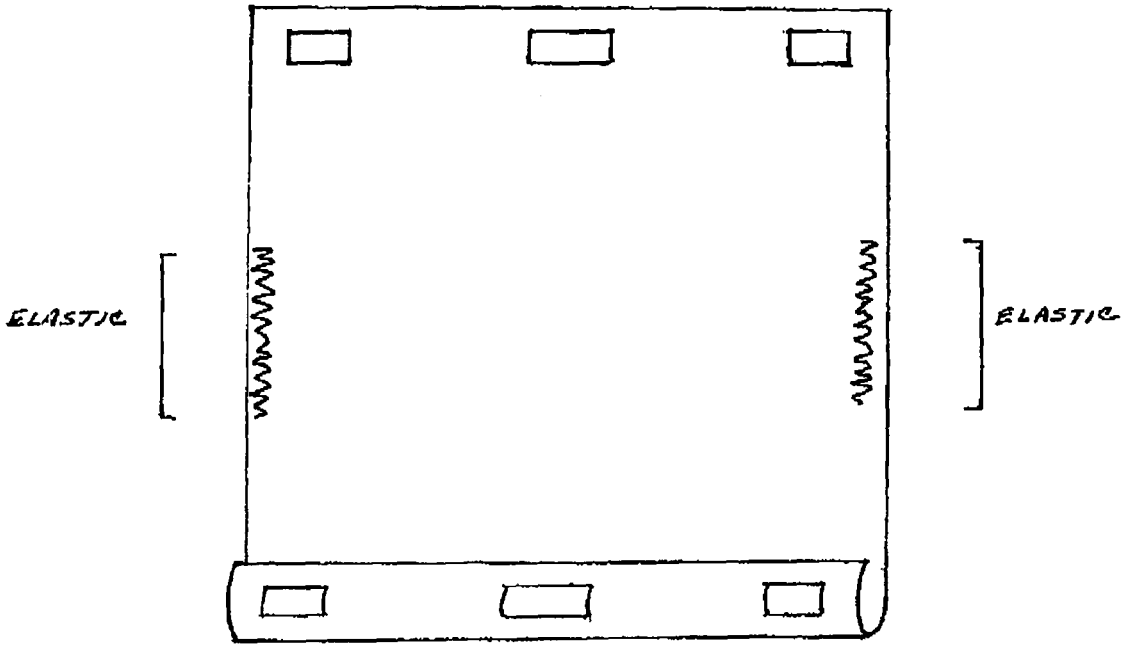
FIG. 2 shows another example of the eyewear protective device in accordance with aspects of the present invention.

Various means may be used to provide this shaping to the device. In a variation shown in FIG. 1, at least one section 7 may be stitched to maintain a pleat in the device. In addition to a stitch, elastic means may be used. Including at least one layer of an elastic type material in the device, or including a smaller section of elastic material attached along the edges of the device as shown in FIG. 2. In addition to such permanent shaping means, hook and loop fasteners, snaps, ties, buttons, and other such openable closures may be used to provide the additional shaping.

The device may be non-abrasive and comprise any material that is soft enough to prevent scratching of an eyewear lens. In one exemplary embodiment, the material may be light weight and flexible enough to be stored in pockets of clothing and sports apparel during use of the goggles. The device may comprise a material that is lightweight enough to be stored in a pocket without providing an undesirable amount of bulk. In one exemplary embodiment, the material is one selected from the group consisting of fleece and other microfiber fabrics. The material may also comprise leather or suede. In another exemplary variation, the device comprises at least two layers, wherein one layer is a liner layer. The device may include more than two layers of material.

Closure maintaining mechanisms (4*a*, 4*b*, 5*a*, 5*b*, 6*a* and 6*b*) are shown in FIG. 1. These closure mechanisms may include hook and loop fasteners, buttons, snaps, clasps, ties, and other such closure mechanisms. The number and placement of the closure mechanisms can vary. For example, the closure maintaining mechanism may include one connecting mechanism, three connecting mechanisms, as shown in FIG. 1, or a number beyond three.

The device can be made in various sizes corresponding to the type of eyewear to be protected. For instance, larger sizes would be used in connection with ski goggles or military type goggles, in contrast to smaller swimming goggles or children sized goggles. The present invention may be used with all types of eyewear, including, but not limited to ski goggles, other snow sport goggles, SCUBA goggles, swimming goggles, other water sport goggles, racquetball goggles, other athletic goggles, protective work goggles, blow torch goggles, motorcycle/riding goggles, military style goggles, and other eyewear.

The present device can be used in combination with a protective case or pouch for the goggles. The present device can also be provided as a feature within a case. For example, the eyewear protective device may be provided as an attachment to a case, where the eyewear protective device wraps around the lens portion of the eyewear and further protects the eyewear from damage caused by items internal to the case, such as a buckle, strap, or earpiece connected to the eyewear.

Figure 3A:
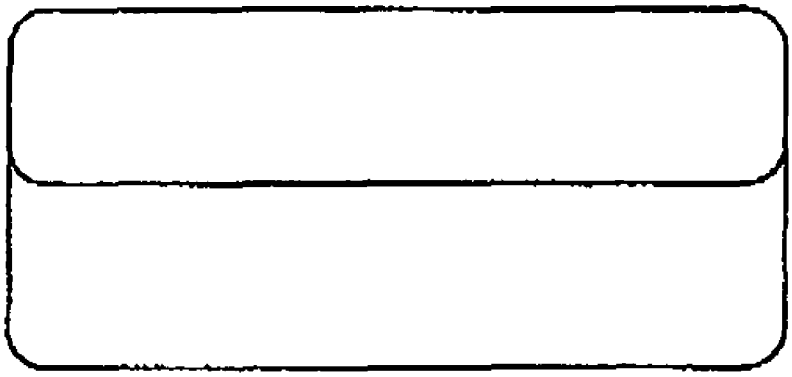
Figure 3B:
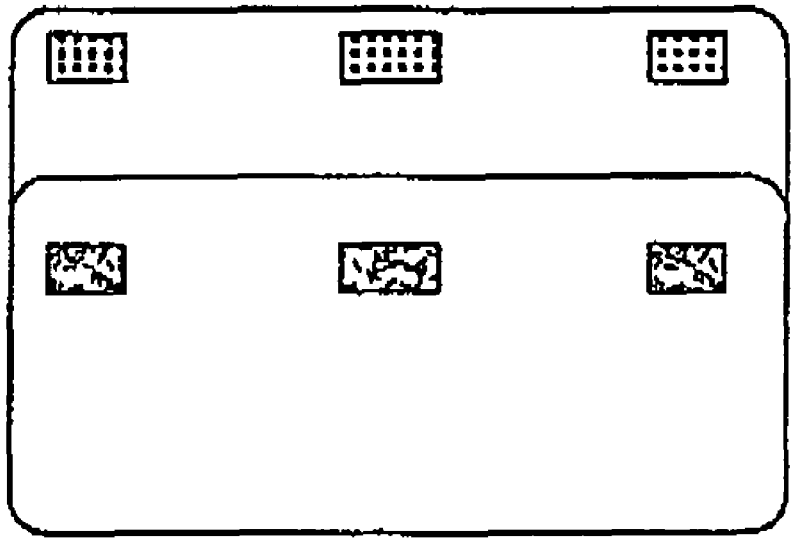
Figure 3C:
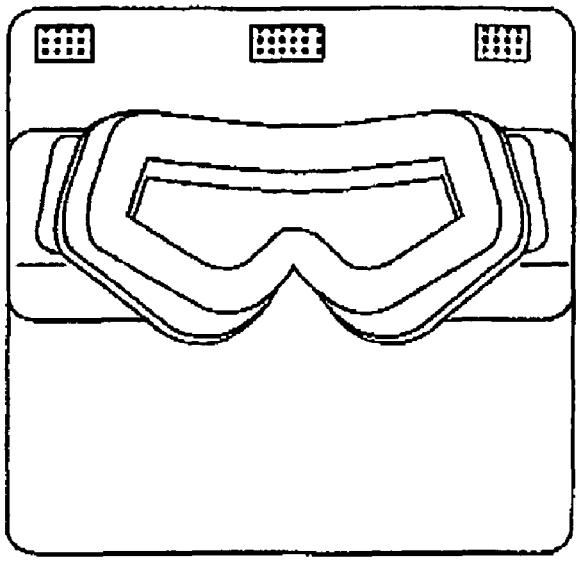
Figure 3D:
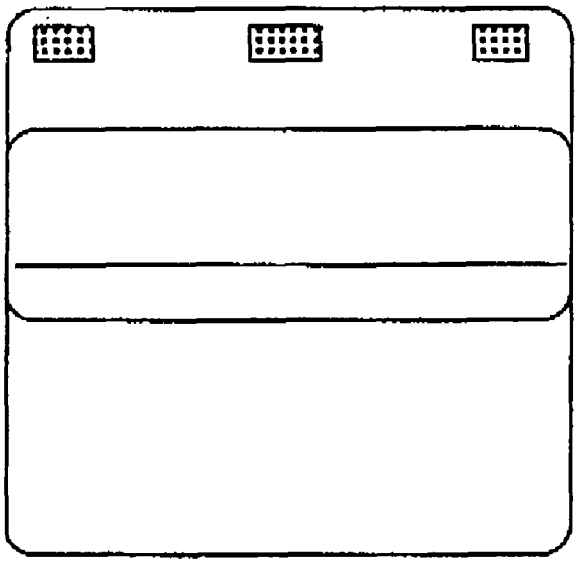
Figure 3E:
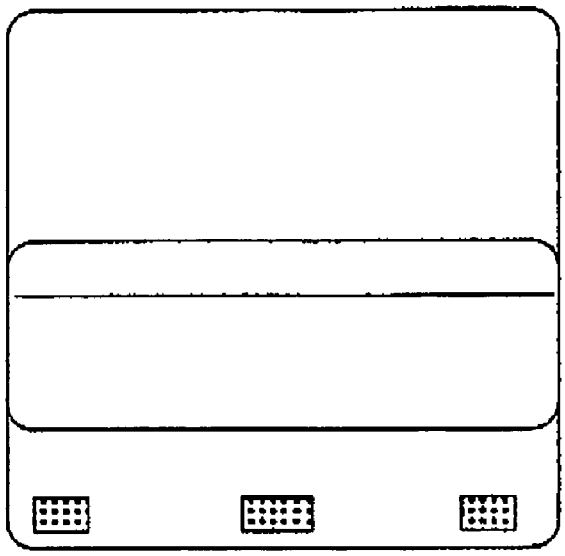
Figure 3F:
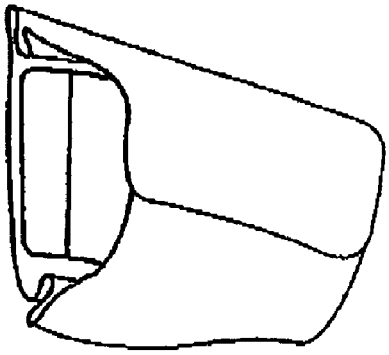
Figure 3G:
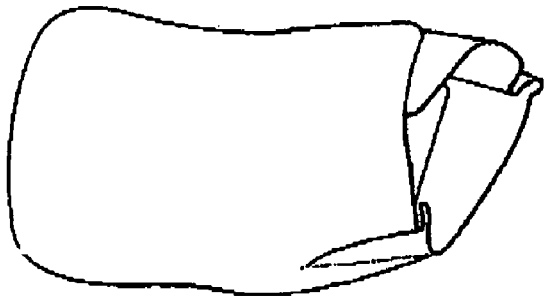

FIGS. 3A-G show an example variation of the present invention in use with a pair of ski goggles. In FIG. 3A, the protective device is in use, wrapped and secured around the lens portion of the goggles. In FIG. 3B, the upper flap, is opened. In FIG. 3C, the upper and lower flaps are opened. FIGS. 3D and 3E show views of the device from the bottom portion. FIG. 3F shows a side view of the device in use with a pair of goggles. FIG. 3G shows an additional view of the device in use with a pair of goggles.

Aspects of the present invention have now been described in accordance with the above advantages. It will be appreciated that these examples are merely illustrative of the invention. Many variations and modifications will be apparent to those skilled in the art.

The invention claimed is:

1. An eyewear protective device, comprising:

a frame configured to surround a lens portion of an item of eyewear and including:

a first end;

a second end;

a central portion located between the two ends; and a closure piece configured to attach the first end to the second end, two pleats on each side of the central portion, stitched or fastened in place and forming a shaping feature, wherein the first and second ends are configured to attach via the closure piece by overlapping on one side of the lens portion of the item of eyewear while the central portion surrounds the opposite side of the lens portion of the item of eyewear and such that the first and second ends overlap between the lens portion of the eyewear and an additional component of the eyewear.

2. The eyewear protective device according to claim 1, wherein the additional component is an attachment piece including at least one selected from a group consisting of an earpiece, a strap, and a buckle.

3. The eyewear protective device according to claim 2, wherein the device comprises a non-abrasive material.

4. The eyewear protective device according to claim 3, wherein the main body comprises a plurality of layers of fabric, and wherein one layer comprises a thinner, liner type fabric.

5. The eyewear protective devise according to claim 3, wherein the non-abrasive material comprises a fabric selected from a group including fleece and microfiber.

6. The eyewear protective device according to claim 1, wherein the shaping feature includes a portion of the device having, on each side, a higher elastic characteristic than other portions of the device.

7. The eyewear protective device according to claim 6, wherein the shaping feature includes an elastic piece attached to each side of the device.

8. The eyewear protective device according to claim 1, wherein the eyewear comprises at least one selected from a group consisting of snow sports goggles, water sports goggles, military-type eyewear, athletic goggles, protective work goggles, and motorcycle/riding goggles.

9. The eyewear protective device according to claim 1, wherein the eyewear piece includes at least one component selected from a group consisting of an earpiece, a strap, and a buckle.

10. The eyewear protective device according to claim 9, wherein the device comprises a non-abrasive material.

11. The eyewear protective device according to claim 10, wherein the device comprises a plurality of layers of fabric, and wherein one layer comprises a thinner, liner type fabric.

12. The eyewear protective device according to claim 10, wherein the non-abrasive material comprises a fabric selected from a group including fleece and microfiber.

13. The eyewear protective device according to claim 10, wherein the device further includes:

a shaping feature that causes the main body to form to the eyewear when the first end and the second end are attached via the closure feature.

14. An eyewear protective system, the system comprising:

an article of eyewear having a lens portion and an additional component;

a frame configured to surround a lens portion of an item of eyewear and including:

a first end;

a second end;

a central portion located between the two ends; and a closure piece configured to attach the first end to the second end, two pleats on each side of the central portion, stitched or fastened in place and forming a shaping feature, wherein the first and second ends are configured to attach via the closure piece by overlapping on one side of the lens portion of the item of eyewear while the central portion surrounds the opposite side of the lens portion of the item of eyewear and such that the first and second ends overlap between the lens portion of the eyewear and an additional component of the eyewear.

* * * * *